US011319913B2

(12) United States Patent
Schoefbaenker et al.

(10) Patent No.: US 11,319,913 B2
(45) Date of Patent: May 3, 2022

(54) INJECTOR FOR INJECTING FUEL

(71) Applicant: LIEBHERR-COMPONENTS DEGGENDORF GMBH, Deggendorf (DE)

(72) Inventors: Norbert Schoefbaenker, Ohlsdorf (AT); Richard Pirkl, Regensburg (DE)

(73) Assignee: LIEBHERR-COMPONENTS DEGGENDORF GMBH, Deggendorf (DE)

( * ) Notice: Subject to any disclaimer, the term of this patent is extended or adjusted under 35 U.S.C. 154(b) by 157 days.

(21) Appl. No.: 16/632,524

(22) PCT Filed: Jul. 20, 2018

(86) PCT No.: PCT/EP2018/069837

§ 371 (c)(1),
(2) Date: Jan. 20, 2020

(87) PCT Pub. No.: WO2019/016398

PCT Pub. Date: Jan. 24, 2019

(65) Prior Publication Data

US 2020/0318596 A1 Oct. 8, 2020

(30) Foreign Application Priority Data

Jul. 20, 2017 (DE) ..... 10 2017 116 383.2

(51) Int. Cl.
*F02M 51/00* (2006.01)
*F02M 63/00* (2006.01)
*F02M 61/16* (2006.01)

(52) U.S. Cl.
CPC ..... *F02M 63/0019* (2013.01); *F02M 61/166* (2013.01); *F02M 63/0033* (2013.01); *F02M 2200/9053* (2013.01)

(58) Field of Classification Search
CPC ..... F02D 41/20; F02D 41/2096; F02D 2041/2003; F02M 51/061; H01F 7/1805; H01H 47/04
(Continued)

(56) References Cited

U.S. PATENT DOCUMENTS

RE34,591 E * 4/1994 Yoshida ..... F02M 45/12 239/533.12
5,692,723 A * 12/1997 Baxter ..... F02M 51/0639 137/550
(Continued)

FOREIGN PATENT DOCUMENTS

DE 19727414 A1 1/1999
DE 10148824 A1 4/2003
(Continued)

OTHER PUBLICATIONS

ISA European Patent Office, International Search Report Issued in Application No. PCT/EP2018/069837, dated Oct. 4, 2018, WIPO, 2 pages.

*Primary Examiner* — John Kwon
(74) *Attorney, Agent, or Firm* — McCoy Russell LLP

(57) ABSTRACT

The present invention relates to an injector for injecting fuel, comprising an injector housing for receiving at least one injector component, and an electromagnet for activating a valve for opening and closing the injector, wherein the electromagnet comprises a coil winding and a magnetic body, wherein the injector housing is formed in one piece with the magnetic body.

12 Claims, 4 Drawing Sheets

(58) Field of Classification Search
USPC ..... 123/490, 494; 239/585.1; 361/154, 155
See application file for complete search history.

(56) References Cited

U.S. PATENT DOCUMENTS

| | | | | |
|---|---|---|---|---|
| 6,123,058 | A * | 9/2000 | Endou | F02D 41/20 123/490 |
| 2016/0025052 | A1 * | 1/2016 | Yasukawa | F02M 51/0614 239/585.1 |
| 2020/0318596 | A1 * | 10/2020 | Schoefbaenker | F02M 63/0019 |

FOREIGN PATENT DOCUMENTS

| | | | |
|---|---|---|---|
| DE | 102005052252 | A1 | 5/2007 |
| DE | 102007000164 | A1 | 10/2007 |
| DE | 102007020285 | A1 | 11/2008 |
| DE | 102011080355 | A1 | 2/2013 |
| EP | 0745764 | A2 | 12/1996 |
| EP | 2053234 | A2 | 4/2009 |
| EP | 2363595 | A1 | 9/2011 |
| WO | 2011054925 | A1 | 5/2011 |

* cited by examiner

Prior Art

Prior Art

INJECTOR FOR INJECTING FUEL

CROSS-REFERENCE TO RELATED APPLICATIONS

The present application is a U.S. National Phase of International Patent Application Serial No. PCT/EP2018/069837 entitled "INJECTOR FOR INJECTING FUEL," filed on Jul. 20, 2018. International Patent Application Serial No. PCT/EP2018/069837 claims priority to German Patent Application No. 10 2017 116 383.2 filed on Jul. 20, 2017. The entire contents of each of the above-referenced applications are hereby incorporated by reference for all purposes.

TECHNICAL FIELD

The present invention relates to an injector for injecting fuel.

BACKGROUND AND SUMMARY

In internal combustion engines such as diesel engines or also petrol engines, fuel is normally injected in a certain quantity and for a certain time into a combustion chamber via an injector. Due to the very short injection periods in the range of microseconds, it is necessary to open and close the outlet opening of the injector at a very high frequency.

An injector typically has an injector needle, which permits highly pressurized fuel to emerge outwards when an outlet hole of the injector is released. In interplay with this outlet opening this injector needle acts like a stopper, which allows fuel to emerge when it is raised. It is necessary according to this, therefore, to lift this needle at relatively short time intervals and after a short time to allow it to slide back into the outlet opening again. Hydraulic servo valves can be used here, which control the activation of this movement. Such valves are activated in turn by means of an electromagnet.

Due to the high injection pressures of over 2500 bar, it is not possible to activate or move the injector needle directly by means of a solenoid valve. In this case the force required to open and close the injector needle would be too great, so that such a method could only be realized by means of very large electromagnets. A design of this kind is ruled out, however, due to the only limited space available in an engine.

Instead of direct activation, so-called servo valves are typically used, which activate the injector needle and are themselves controlled via an electromagnetic valve. In a control chamber interacting with the injector needle, a pressure level is built up here by means of the fuel available under high pressure, which level acts on the injector needle in the closing direction. This control chamber is typically connected via a supply throttle to the high-pressure area of the fuel. Furthermore, this control chamber has a small, closable outlet throttle from which the fuel can escape. If it does this, the pressure in the control chamber and the closing force acting on the injector needle is reduced, as the fuel of the control chamber under high pressure can flow off. This causes a movement of the injector needle, which releases the outlet opening at the injector tip. To be able to control the movement of the injector needle, the outlet throttle of the valve is thus optionally closed or opened by means of an anchor element.

The valve itself can be brought in turn into the desired position by means of an electromagnet. If the electromagnet is in a de-energized state, a certain spring force is required, which presses the anchor element against the outlet throttle (=opening of the valve). In an energized state of the electromagnet, the anchor element is pulled against the spring force exerted by the spring element, so that compression of the spring occurs, and it releases the outlet throttle of the valve. It should be stated here that the magnetic circuit of the electromagnet represents a substantial cost constituent of the injector as a whole, as this accounts for approx. 42% of the overall injector manufacturing costs.

The object of the present invention is therefore to reduce the manufacturing costs, in particular with regard to the costs incurred for the magnetic circuit and the electromagnet, with the same or reduced dimensions of the injector.

This is achieved by means of the injector according to the invention, which has all the features of claim 1. The injector according to the invention accordingly comprises for the injection of fuel an injector housing for receiving at least one injector component and an electromagnet for activating a valve for opening and closing the injector, wherein the electromagnet has a coil winding and a magnetic body. The injector according to the invention is characterized in that the injector housing is formed in one piece with the magnetic body.

Due to the provision of injector housing and magnetic body of the electromagnet in one piece, the number of components and complexity is reduced, which leads in turn to a reduction in the manufacturing costs of the injector. From the prior art only injectors are known that have a separate magnetic assembly, which is designed independently of the injector housing and is also manufactured independently of this. It is the case here that the injector housing in the assembled state tends to constitute a disturbance variable in the magnetic circuit and also causes the problem that, due to the reduced diameter available in the case of simultaneous provision of injector housing and a magnetic assembly separate from this, only small pole faces can be provided, which gives rise to the necessity of having to use very high-quality and expensive materials for the magnetic core.

This problem is circumvented or solved by the present invention, as the injector housing is formed in one piece with the magnetic body. With an implementation of this kind, the manufacturing costs for the solenoid valve, which comprises the electromagnet and an anchor element, can be reduced by approx. 85% compared with the implementations known from the prior art.

According to a development of the present invention, the coil winding is mounted directly on the injector housing, the coil winding is preferably wound around an external circumferential surface of the injector housing.

By mounting the magnetic coil directly on the injector housing a larger pole face can be created, so that a less high-quality material can be used for the magnetic core than for injectors known from the prior art. This results in considerable savings effects.

According to an optional modification of the present invention, the magnetic body has a magnetic inner pole, which is provided inside the coil winding, and a magnetic outer pole, which is provided outside the coil winding, wherein the injector housing is connected in one piece to the magnetic inner pole and/or the magnetic outer pole.

It is possible accordingly for the injector housing to be formed in one piece with the magnetic inner pole or with the magnetic outer pole. Furthermore, it is comprised by the invention that both the magnetic inner pole and the magnetic outer pole are formed in one piece with the injector housing.

According to a preferred variant of the invention, the injector housing comprises a Cr—Mo-alloyed heat-treated steel or consists of this, wherein the Cr—Mo-alloyed heat-treated steel is preferably 50CrMo4.

If the injector housing is manufactured from heat-treated steel with a chromium-molybdenum alloy, a good ratio is achieved of high-pressure pulsating fatigue strength and the desired magnetic properties. Here heat-treated 50CrMo4 represents the optimum with reference to high-pressure pulsating fatigue strength and the magnetic properties. It is particularly preferable to produce the steel in a particularly high purity.

It is preferably provided that the first injector housing comprises a first injector housing section and a second injector housing section, and one of the two injector housing sections is connected in one piece to the magnetic body or both injector housing sections are connected in one piece to the magnetic body.

If the injector housing is subdivided into several sections, the assembly and joining together of the injector can be carried out more easily.

It can further be provided that the coil winding of the electromagnet is mounted directly on the first injector housing section and is preferably wound here around an outer circumferential surface of the first injector housing section. In this case the coil winding can come directly into contact with the first injector housing section.

According to another optional development of the invention, the injector further comprises a valve for exerting a variable pressure on an injector needle, wherein the second injector housing section adjoins the valve.

This valve has an outlet throttle, which can be closed by means of an anchor element supported movably in the injector. In a closed state of the valve, such great pressure is exerted on the injector needle that this closes the injector outlet. If the outlet throttle opens due to lifting of the anchor element, on the other hand, the pressure level sinks and permits the injector needle to be raised from its closed position.

It can further be provided that the second injector housing section supports the anchor element for optional closing of the outlet throttle.

Furthermore it can be provided according to the invention that the second injector housing section is joined in one piece to a part of the magnetic body provided outside the coil winding. It is advantageous if the part of the magnetic body provided outside the coil winding directly adjoins the coil winding.

According to another development of the invention, the first injector housing section is joined in one piece to a part of the magnetic body provided inside the coil winding.

According to another variant of the invention, the injector further comprises an anchor element for optional closing of a valve opening, wherein the anchor element is movable by the electromagnet.

It can thus be provided that in an energized state of the electromagnet, the anchor element is moved into a position in which the anchor element forms a magnetic circuit together with a magnetic inner pole and a magnetic outer pole of the magnetic body.

A magnetic flux thus arises across the injector housing and the anchor element, which is also termed anchor in the technical jargon.

It is advantageous here if the anchor element in this position, which is achieved in an energized state of the electromagnet, contacts both the magnetic inner pole and the magnetic outer pole, wherein preferably in this position the valve opening is in an open position.

According to another modification of the present invention, the anchor element comprises a steel heat-treated with chromium and molybdenum or consists of this. It can also be provided here that the anchor element consists of 50CrMo4.

According to another development of the present invention, the injector housing is an injector outer housing. It thus constitutes the outer completion of the injector at least in sections.

It can further be provided that the injector housing, preferably the first injector housing section and/or the second injector housing section, has a duct for the flowing or guiding of fuel from one or more bores distributed on the circumference. This duct is thus located in the injector housing itself. This duct can preferably be introduced into the injector housing by means of drilling, for example, or a similar method.

The invention further comprises an internal combustion engine with an injector, which is executed according to one of the variants described above.

BRIEF DESCRIPTION OF THE FIGURES

Other features, details and advantages of the present invention are evident with reference to the following description of the figures. In these

DETAILED DESCRIPTION

Figure 1:
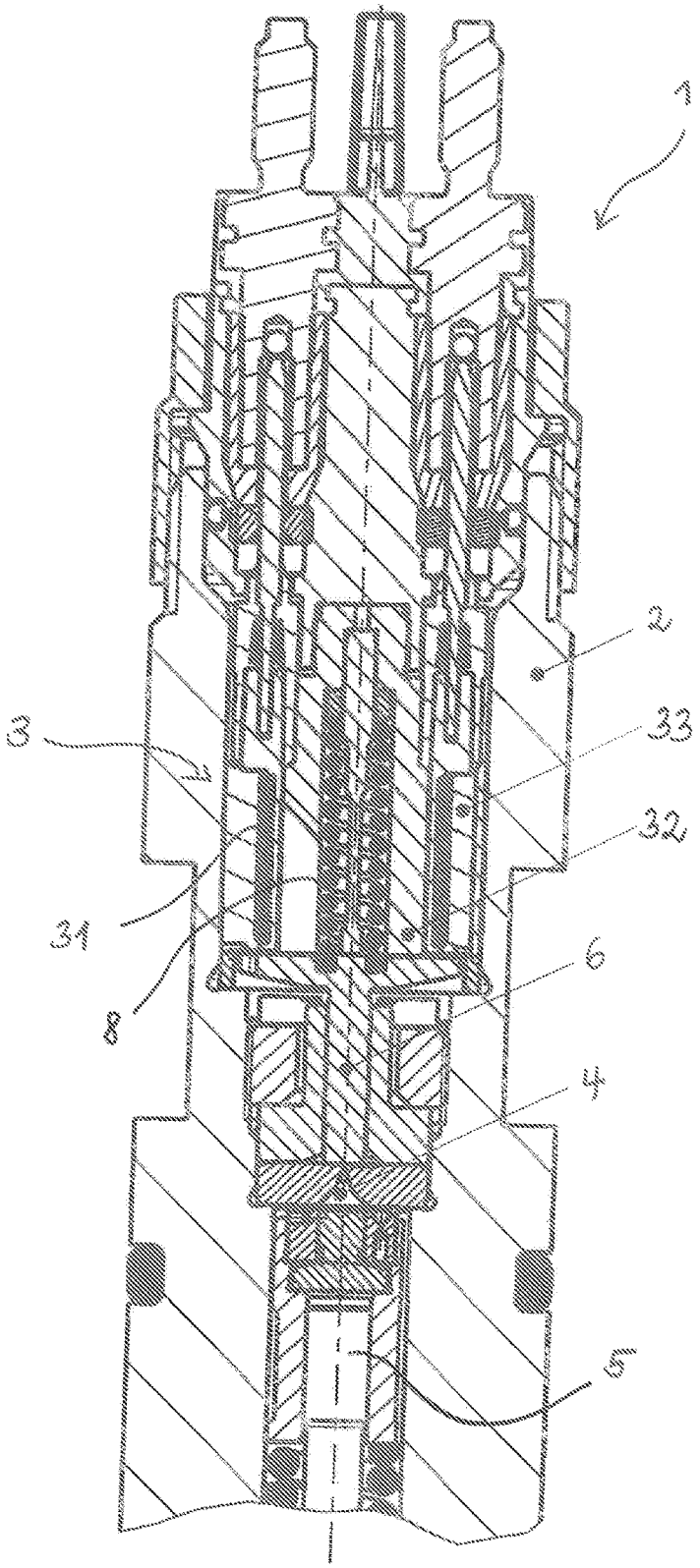
FIG. 1 shows a partial cross section of a conventional injector.

FIG. 1 shows a partial sectional view of an injector from the prior art. The injector 1 is recognized, which has a housing 2 in which a plurality of injector components is arranged. Substantial for the function of the injector 1 here are the injector needle 5, the valve 4, the anchor element 6 and the electromagnet 3, which has a coil winding 31, an inner magnetic pole 32 and an outer magnetic pole 33. Moreover, there is provided in the inner magnetic pole 32 a recess for arranging the spring 8, which presses the anchor element 6 in the direction of the valve 4 in order to close the outlet throttle of the valve 4 in a fluid-tight manner in a de-energized state of the electromagnet.

If the electromagnet 3 is activated, this pulls the anchor element 6 away from the valve 4 by means of magnetic force, so that fuel under high pressure can flow out of a control chamber that can be closed by the valve 4. Since the pressure in the control chamber that acts on the injector needle 5 is reduced by this, the latter can slide out of a closing position and permits the discharge of fuel from the injector 1. If the electromagnet 3 is put into a de-energized state, on the other hand, the magnetic force acting on the anchor element 6 decreases, so that the spring element 8 presses the anchor element 6 onto the outlet opening of the valve 4 and seals off the control chamber. The pressure acting on the injector needle 5 rises due to this, due to which this is pressed back into its closing position. A flow of fuel out of the outlet opening of the injector 1 accordingly no longer takes place.

Figure 2:
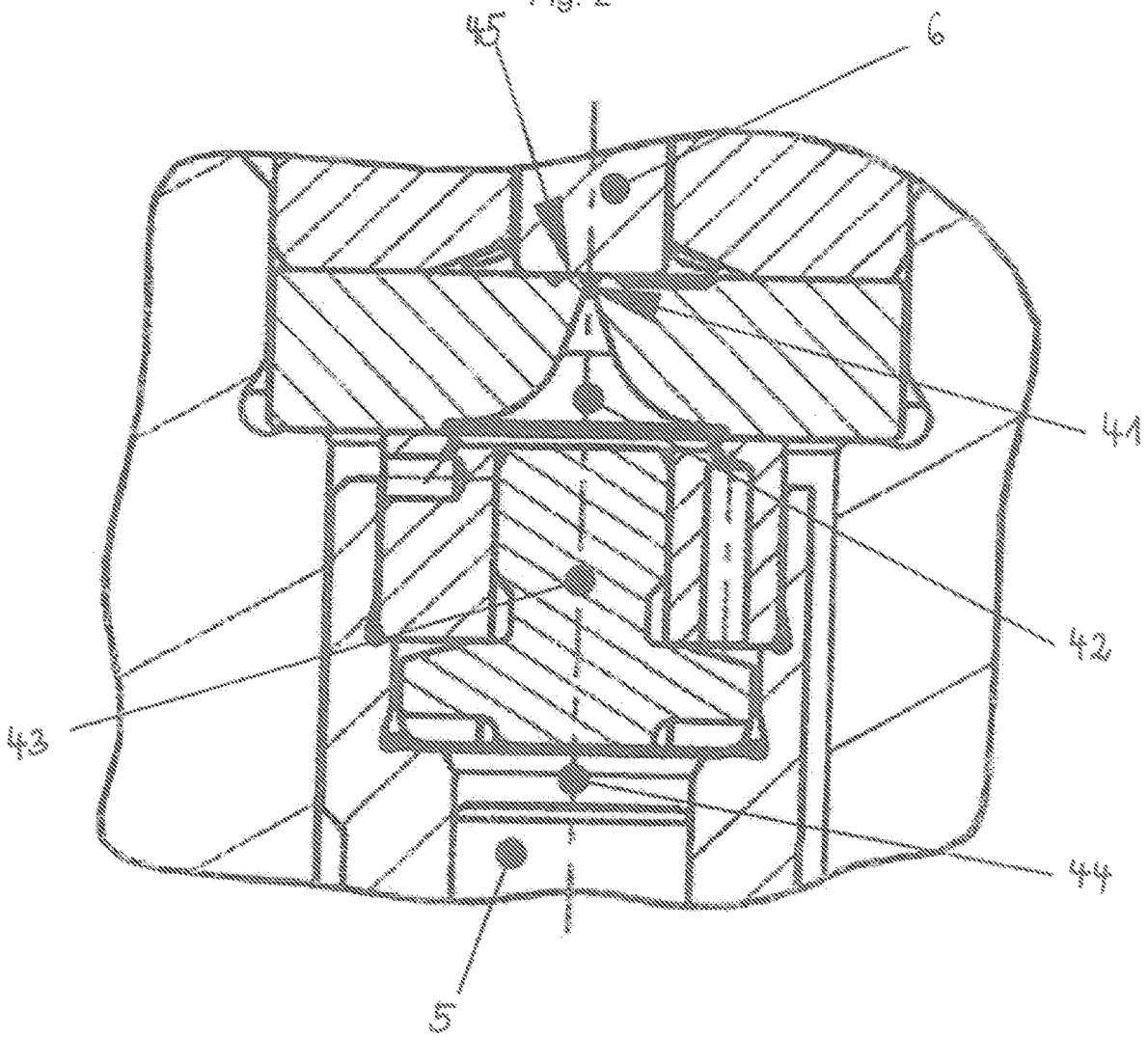
FIG. 2 shows an extract of FIG. 1 in an enlarged depiction to explain the mode of operation of an injector.

FIG. 2 shows an enlarged depiction in the lower area of the anchor element 6 in a closed state of the valve 4. The drain throttle 41 is recognized, which constitutes an outlet for fuel stored under high pressure in a control chamber 44. If the anchor element 6 is not on the sealing seat 45 of the valve 4, the fuel taken up under high pressure from the control chamber 44 can flow out via a passage space 42 into a low-pressure area. The valve 4 can also be provided here with a movable valve insert 43, by means of which the force acting on the injector needle 5 can be dissipated or built up particularly quickly.

Figure 3:
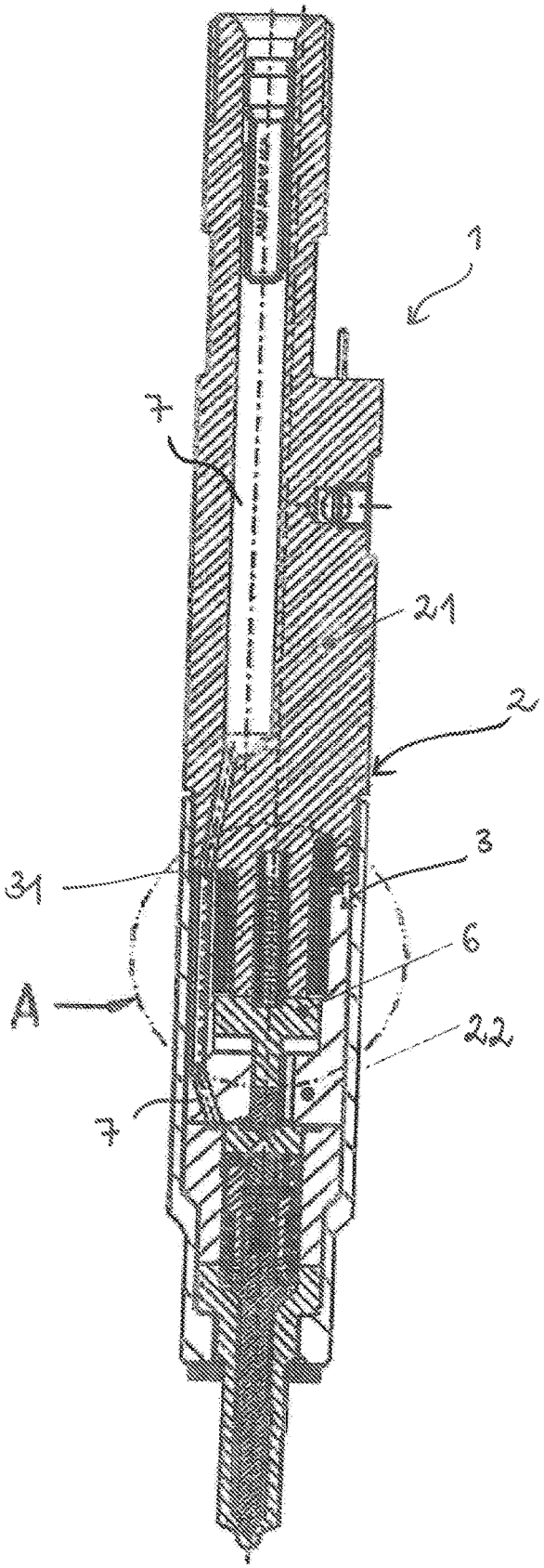
FIG. 3 shows a cross section of an injector according to the invention.

FIG. 3 shows a cross section along the longitudinal direction of an injector according to the invention. A duct 7 for supplying fuel is recognized, wherein this is arranged in a first housing section 21 of the injector 1. At the same time, the injector housing 2 also constitutes a magnetic body of the electromagnet 3. In the present figure, the injector housing 2 is divided into a first injector housing section 21 and a second injector housing section 22. The first injector housing section 21 is also an outer housing of the injector 1. Furthermore, the first injector housing section 21 is simultaneously a magnetic inner pole of the electromagnet 3. The second injector housing section 22 constitutes a magnetic outer pole of the electromagnet 3. The magnetic inner pole is separated from the magnetic outer pole by a coil winding 30. The first injector housing section 21 and the second injector housing section 22 are further characterized in that they each have a duct for carrying fuel in their bodies.

Figure 4:
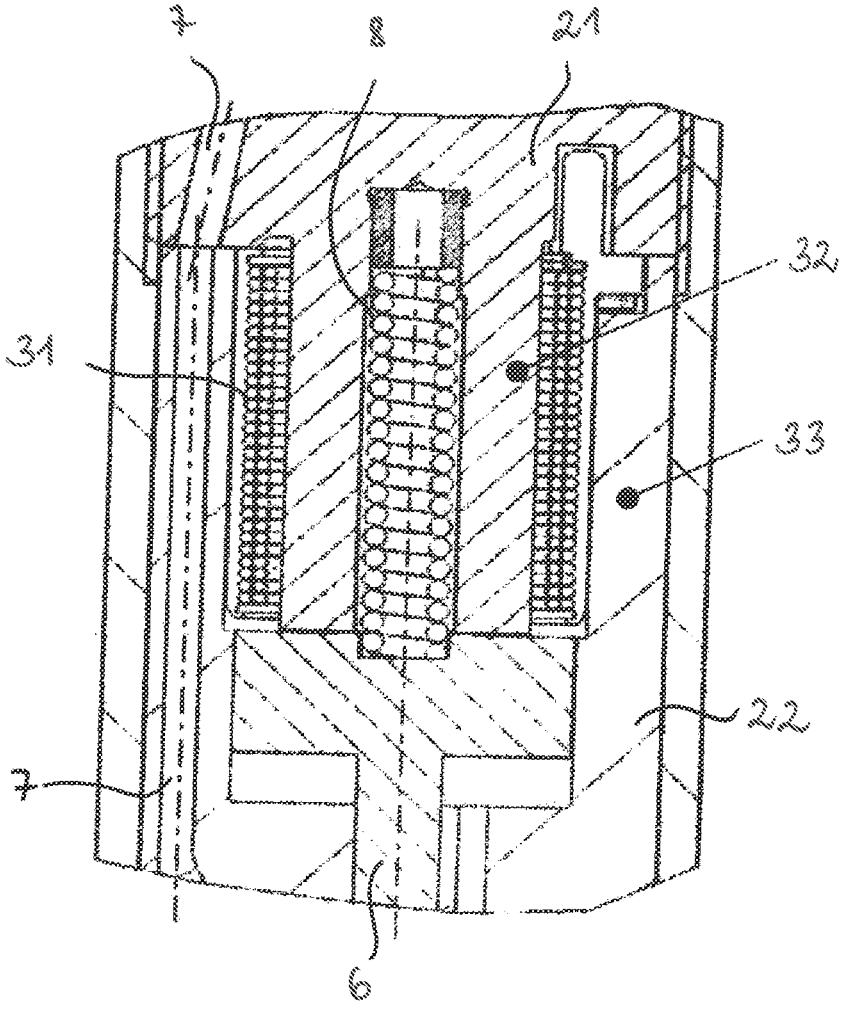
FIG. 4 shows an extract from FIG. 3 in an enlarged depiction to explain the different features compared with the prior art.

FIG. 4 shows an enlarged section from FIG. 3, which shows the area around the electromagnet 3. The coil winding 31 is recognized, which is wound around an outer circumferential section of the first injector housing section 21 and thus constitutes the magnetic inner pole of the electromagnet 3 at the same time. Outside around the coil winding 31 there is further provided a magnetic outer pole 33, which simultaneously also constitutes a second injector housing section 22.

A duct 7 for guiding fuel or another fluid runs here through the first injector housing section 21 and through the second injector housing section 22 also.

In the state depicted in FIG. 4, the coil winding 31 is shown in an energized state, as the anchor element 6 is lifted from its closing position from the outlet throttle of the valve. To bring the anchor element 6 into such a position, it is necessary to overcome the closing force exerted by means of the spring 8, which is achieved by the electromagnet 3. In the configuration depicted a magnetic flux or a magnetic circuit is advantageously formed, which runs from the magnetic inner pole 32 via the anchor element 6 to the magnetic outer pole 33. A magnetic flux is accordingly created, therefore, via the injector housing 2 and the anchor element 6 (also: plunger).

With an injector 1 formed in this way, the manufacturing costs for the solenoid valve can be reduced by approx. 85%. What is also advantageous about this is the lower number of components that can be achieved due to the now no longer separately required magnetic components.

The invention claimed is:

1. An injector for injecting fuel, comprising:

an injector outer housing for receiving at least one injector component, the injector outer housing comprising a first injector housing portion and a second injector housing portion; and an electromagnet for activating a valve for opening and closing the injector, the electromagnet comprising a coil winding and a magnetic body having a magnetic inner pole inside the coil winding and a magnetic outer pole outside the coil winding, the first injector housing portion formed in one piece with the magnetic inner pole and comprising a conduit for supplying fuel.

2. The injector according to claim 1, wherein the coil winding is wound around an outer circumferential surface of the injector outer housing.

3. The injector according to claim 1, wherein the injector outer housing comprises a Cr—Mo-alloyed heat-treated steel.

4. The injector according to claim 1, wherein the injector outer housing comprises a second injector housing section, and both injector housing sections are joined in one piece to the magnetic body.

5. The injector according to claim 4, wherein the coil winding of the electromagnet is wound around an outer circumferential surface of the first injector housing portion.

6. The injector according to claim 4, further comprising a valve for exerting a variable pressure on an injector needle, wherein the second injector housing section adjoins the valve.

7. The injector according to claim 4, wherein the second injector housing section is joined in one piece to a part of the magnetic body provided outside the coil winding.

8. The injector according to claim 1, further comprising an anchor element for optional closing of a valve opening, wherein the anchor element is movable by the electromagnet.

9. The injector according to claim 8, wherein the anchor element is moved in an energized state of the electromagnet into a position in which the anchor element forms a magnetic circuit together with the magnetic inner pole and the magnetic outer pole of the magnetic body.

10. The injector according to claim 9, wherein the anchor element in this position contacts both the magnetic inner pole and the magnetic outer pole.

11. The injector according to claim 1, wherein the injector outer housing has a duct for the flowing of fuel from one or more bores distributed on the circumference.

12. An internal combustion engine with the injector according to claim 1.

* * * * *